US005333952A

United States Patent [19]

Perdue

[11] Patent Number: 5,333,952

[45] Date of Patent: Aug. 2, 1994

[54] CHEMICAL MIXING CHAMBER

[76] Inventor: John L. Perdue, 4442 White Acres Rd., Montgomery, Ala. 36106

[21] Appl. No.: 107,306

[22] Filed: Aug. 17, 1993

[51] Int. Cl.[5] ..... B01F 5/06

[52] U.S. Cl. ..... 366/336; 366/340

[58] Field of Search ..... 366/336, 337, 150, 338, 366/339, 340, 348, 349

[56] References Cited

U.S. PATENT DOCUMENTS

| | | | |
|---|---|---|---|
| 2,784,530 | 3/1957 | Dugan . | |
| 3,286,992 | 11/1966 | Armeniades et al. . | |
| 4,033,866 | 7/1977 | Enzmann . | |
| 4,175,035 | 11/1979 | Moyer, Jr. . | |
| 4,189,243 | 2/1980 | Wesley | 366/336 |
| 4,448,539 | 5/1984 | Burgert | 366/336 |
| 4,696,750 | 9/1987 | Donald . | |
| 4,994,242 | 2/1991 | Rae | 366/336 |

*Primary Examiner*—Robert W. Jenkins

*Attorney, Agent, or Firm*—Richard C. Litman

[57] ABSTRACT

A chemical mixing chamber for use in the plating industry is disclosed. The device is particularly useful in the mixing of long chain molecule polymers with water, to break up the polymer in order to provide greater surface area. This is advantageous in mixing the polymer material with solutions of metal acid residue, as the resulting greater surface area of the polymer provides for better electrostatic attraction to the ions in solution. The present invention provides for the efficient breakup of the polymer material, in a device having no moving parts. The water inlet and water-polymer outlet are coaxial, thus providing for ease of installation in a line. The device may be constructed of standard parts and components, and may be formed of various materials (PVC plastic,, stainless steel, iron or other metal pipe,, etc.) as required for the particular environment, and may be used as a mixing chamber for various types of fluids or liquids in various industries and environments.

3 Claims, 2 Drawing Sheets

CHEMICAL MIXING CHAMBER

FIELD OF THE INVENTION

The present invention relates generally to devices providing for the mixing of two or more chemicals or fluids, and more specifically to such a device providing for the coaxial inlet flow of a first fluid (e.g., water) and radial inlet flow of a second fluid (e.g., a long chain polymer), with coaxial outlet flow of the mixed fluids.

BACKGROUND OF THE INVENTION

In our increasingly crowded world, it has become more and more critical to proceed with caution in terms of potentially environmentally hazardous materials. This is particularly true in the plating industry, where many, if not most, of the metals and chemicals used are potential health hazards. Moreover, it has become increasingly costly to simply dispose of such materials, when in at least some cases they may be recycled to salvage at least some of the costly metals and chemicals. In the plating industry, it is necessary to remove metallic acid waste residue from other solutions: this is commonly done by means of a long chain molecular structure "neat" polymer (i.e., a polymer material providing an electrostatic attraction to metallic ions in solution).

In order to achieve maximum efficiency, the relatively viscous polymer must be thinned in some manner, in order to provide a maximum polymer surface area for the attraction of the metallic ions. Water is often used for this purpose. However, heretofore the water-polymer mixing devices have been relatively complex, costly, and have had less than perfect reliability, resulting in down time for the process and relatively costly repairs.

The need arises for a water—polymer mixing chamber which may be installed in line between a water inlet and a mixed polymer outlet line. The device must provide for thorough mixing of the two substances, and must resist chemical or other deterioration. For utmost simplicity and reliability, the device must include no moving parts, and must be relatively economical to purchase, install, use, maintain, and replace. Finally, the device must be adaptable for use in the mixing of other fluids than water and polymer.

DESCRIPTION OF THE PRIOR ART

U.S. Pat. No. 2,784,530 issued to John W. Dugan on Mar. 12, 1957 discloses a Method For Mixing Ammonia With Water And Introducing The Mixture Into The Soil. The method includes two concentric pipes, with the center pipe having a plurality of lateral passages therethrough to allow the interior of the center pipe to communicate with the interior of the outer pipe. No closure is provided for the outer pipe; the end is open to act as an outlet. Thus, only one level of mixing is provided by the plurality of passages in the walls of the central pipe. Moreover, as the device is intended to be driven into and drawn through the soil, it must be constructed of relatively tough and durable metal material. The polyvinyl chloride plastic composition of the primary embodiment of the present invention would not be suitable, nor would the metal material of the Dugan device be suitable in the environment of the present invention due to the electrolytic corrosive nature of the chemicals being processed.

U.S. Pat. No. 3,286,992 issued to Constantine Do Armeniades et al. on Nov. 22, 1966 discloses a Mixing Device comprising only a single pipe with a series of helical vanes inserted therein. The twist of the vanes provides for mixing of chemicals (polyester resins) therein. The vanes may also include holes therein for further mixing, but the holes do not provide for the injection or input of a separate fluid or liquid into the pipe, as in the present invention. As in the case of the Dugan device discussed above, the end of the pipe is open.

U.S. Pat. No. 4,033,866 issued to Sigmund J. Enzmann on Jul. 5, 1977 discloses a Method For Separating Foreign Solid Particles From A Liquid. The method includes a tank having a rotating magnetic drum therein, serving to attract ferrous metal particles. A scraper acts to remove the particles from the rotating drum. Various other components are also included, and the environment and function of the device (i.e., separating materials rather than mixing them) is beyond the scope of the present invention.

U.S. Pat. No. 4,175,035 issued to William H. Moyer, Jr. on Nov. 20, 1979 discloses a Method For Increasing Fine Coal Filtration Efficiency. The method includes a series of screens for sizing the particles, a centrifuge, and other components and steps, and accordingly is beyond the scope of the present invention, particularly when considered in its intended function as a separating system, rather than a mixing system as in the case of the present invention. While the present invention is employed in a system providing for the separation of materials, the present invention itself is directed to the mixing of fluids rather than the qualitative separation of different fluids or materials.

Finally, U.S. Pat. No. 4,696,750 issued to Jay Donald on Sep. 29, 1987 discloses the Flocculation Of Particles By Polymers That Precipitate Out Of Solution. The method disclosed is directed to the removal of coke and catalyst fines from solution, and is related to the treatment methods with which the mixing chamber of the present invention is used. However, Donald does not disclose any specific apparatus for his method, or for any of the steps thereof.

None of the above noted patents, taken either singly or in combination, are seen to disclose the specific arrangement of concepts disclosed by the present invention.

SUMMARY OF THE INVENTION

By the present invention, an improved chemical mixing chamber is disclosed.

Accordingly, one of the objects of the present invention is to provide an improved chemical mixing chamber which provides for the thorough mixing of water and a long chain polymer material.

Another of the objects of the present invention is to provide an improved chemical mixing chamber which contains no moving parts.

Yet another of the objects of the present invention is to provide an improved chemical mixing chamber which provides for a concentric inlet and outlet.

Still another of the objects of the present invention is to provide an improved chemical mixing chamber which is resistant to attack and corrosion by chemical agents.

A further object of the present invention is to provide an improved chemical mixing chamber which may be constructed using standard, off the shelf components.

An additional object of the present invention is to provide an improved chemical mixing chamber which may be constructed of plastics (e.g., polyvinyl chloride), metals (e.g., stainless steel or ferrous metal pipe), or other materials according to the environment in which the device will be used.

A final object of the present invention is to provide an improved chemical mixing chamber for the purposes described which is inexpensive, dependable and fully effective in accomplishing its intended purpose.

With these and other objects in view which will more readily appear as the nature of the invention is better understood, the invention consists in the novel combination and arrangement of parts hereinafter more fully described, illustrated and claimed with reference being made to the attached drawings.

BRIEF DESCRIPTION OF THE DRAWINGS

Similar reference characters denote corresponding features consistently throughout the several figures of the attached drawings.

DETAILED DESCRIPTION OF THE PREFERRED EMBODIMENT

Figure 1:
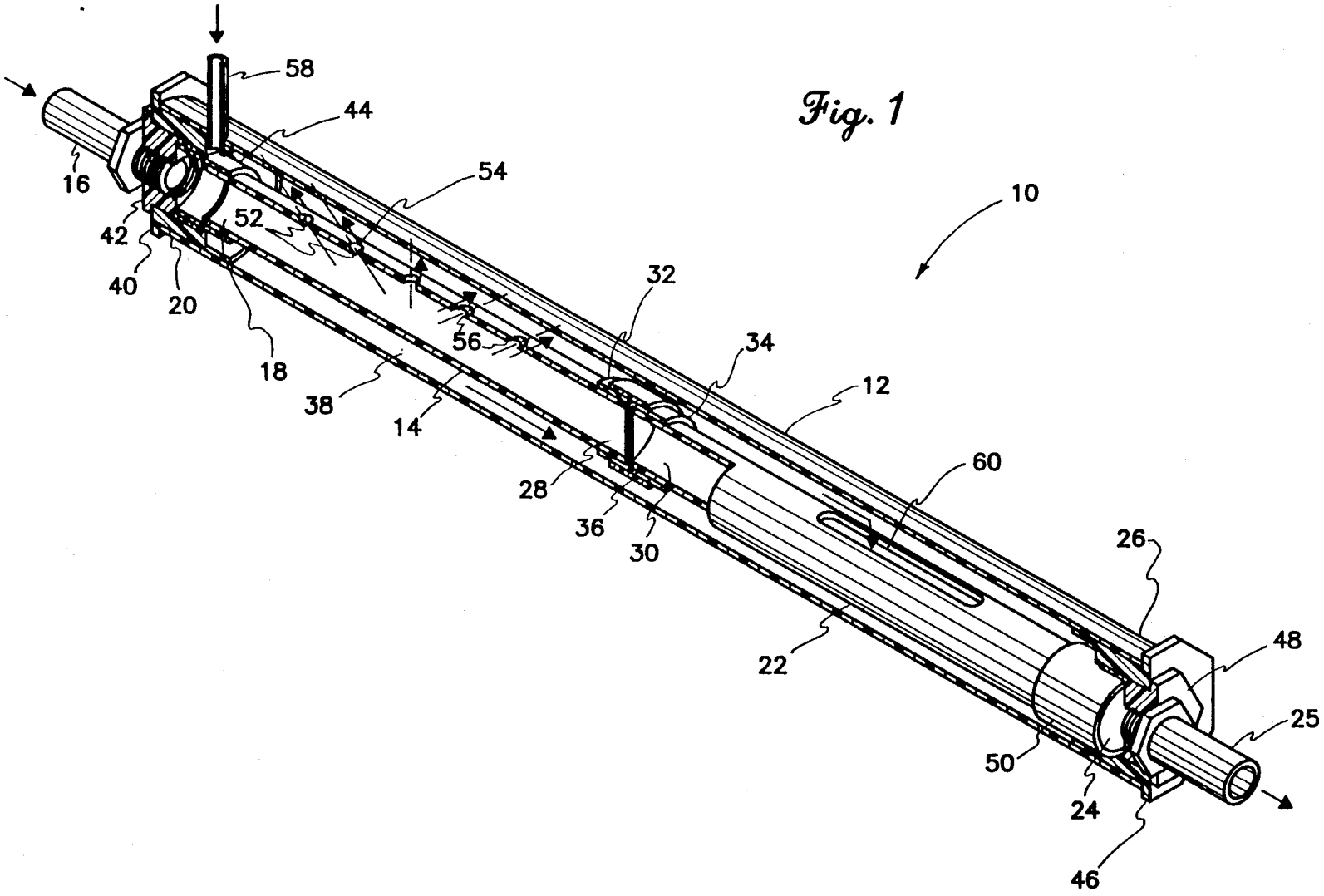
FIG. 1 is a perspective view in section of the present invention, showing its various components and features.

Referring now particularly to FIG. 1 of the drawings, the present invention will be seen to relate to a chemical mixing chamber 10 having an outer housing 12 preferably formed of an elongate cylindrical pipe or tube. A first inner pipe or tube 14 is installed within the outer housing 12, and communicates with an inlet tube or pipe 16 sealingly secured to the first or inlet end 18 of the inner pipe or tube 14 and also to the first or inlet end 20 of the outer housing 12. A second inner pipe or tube 22 is also installed within the outer housing 12, and has a first or outlet end 24 which communicates with an outlet pipe or tube 25 extending from the second or outlet end 26 of the outer housing 12.

It will be noted that while the outer housing 12 and the two inner tubes or pipes 14 and 22 provide a continuous fluid pathway therethrough, the first and second inner pipes 14 and 22 do not directly communicate with one another. While there is no requirement that they be axially connected as shown in FIG. 1, such a configuration serves to provide additional structural strength for the interior of the present invention. Thus, preferably the second end 28 of the first inner pipe or tube 14 and the second end 30 of the second inner pipe or tube 22 are each respectively sealed by means of closely fitting caps 32 and 34, with an overlying closely fitting sleeve 36 installed over the caps 32 and 34 to provide rigidity to the internal structure. Other means of sealing the second ends 28 and 30 of the two inner pipes 14 and 22 may be used, e.g., a disk formed of some chemically impervious material (such as Teflon, TM) interposed between the two ends 28 and 30, with a sleeve directly installed thereover. The primary requirement is that no flow be allowed directly between the two second ends 28 and 30 of the two inner pipes or tubes 14 and 22.

It will be noted that the diameters of the two inner pipes or tubes 14 and 22 are considerably less than that of the outer housing 12, thus providing a mixing space 38 between the inner pipes or tubes 14 and 22 and the outer housing 12. The preferred embodiment of the present invention has been constructed so as to make use of standard, off the shelf components insofar as possible, and as such, first and second inlet reducing bushings 40 and 42 and an inlet coupling 44 may be required between the first end 20 of the outer housing 12 and the first end 18 of the first inner pipe or tube 14, in order to provide a positive seal therebetween. In a similar manner, first and second outlet reducing bushings 46 and 48 and an outlet coupling 50 may be provided between the second or outlet end 26 of the outer housing and the first end 24 of the second inner pipe or tube 22. The size differences provided by such bushings 40, 42, 46 and 48 (and couplings 44 and 50, as needed) provide for a significant difference in inner pipe or tube diameters and the diameter of the outer housing 12, thus providing sufficient mixing space therebetween for the thorough and efficient mixing of fluids introduced therein. It will be noted that the above construction provides for a rigid device with all components being relatively fixed; the present invention includes no moving parts. The use of standard fittings, such as the reducing bushings and couplings 40 through 50 described above, will be seen to provide for the mutually concentric installation of the inlet pipe or tube 16, the first inner pipe or tube 14, the second inner pipe or tube 22, and the outlet pipe or tube 25 relative to the outer housing 12.

The mixing space 38 provides for the mixing of two different fluids, as noted above. The first fluid is introduced to the mixing space 38 by means of the first inner pipe or tube 14 and a plurality of first, second and third passages 52, 54 and 56 extending through the wall of the first inner pipe or tube 14 to allow fluid flow between the interior of the first inner pipe or tube 14 and the mixing space 38. The second fluid enters the mixing space 38 by means of a second inlet tube or pipe 58 communicating directly with the mixing space 38. The second inlet pipe or tube 58 may be radially disposed from the side of the outer housing 12, and is preferably installed adjacent the first end 20 of the outer housing 12 in order to provide for flow of the second fluid along essentially the entire length of the first inner pipe or tube 14, thus being exposed completely to the mixing action of the first fluid exiting the passages 52 through 56. It will be seen that the first, second and third passage groups 52 through 56 may be disposed at various angles to the wall of the first inner pipe or tube 14. In the preferred embodiment, at least the first set of passages 52 is formed at a 45 degree angle toward the second fluid inlet tube or pipe 58, the second passage or passages 54 is/are formed at a 90 degree angle, and the third set of passages are formed at a 45 degree angle away from the inlet tube or pipe 58. The different angles between the various passages 52 through 56 provide more efficient mixing of the fluid exiting therefrom, with the fluid entering the mixing space 38 from the second fluid inlet tube or pipe 58.

The mixed first and second fluids then flow toward the second end 26 of the outer housing 12, where they enter a passage or passages 60 formed in the side of the second inner pipe or tube 22. This passage 60 allows the mixed fluids to flow into the second pipe or tube 22 and out of the mixing chamber 10 by means of the outlet pipe or tube 25, which connects to the second inner pipe or tube as explained above. The passage(s) 60 in the side of the second inner pipe/tube 22 may be in the form of an elongated slot axially parallel to the pipe/tube 22, or alternatively may be provided in some other form (e.g., one or more round or otherwise shaped holes, etc.)

Figure 2:
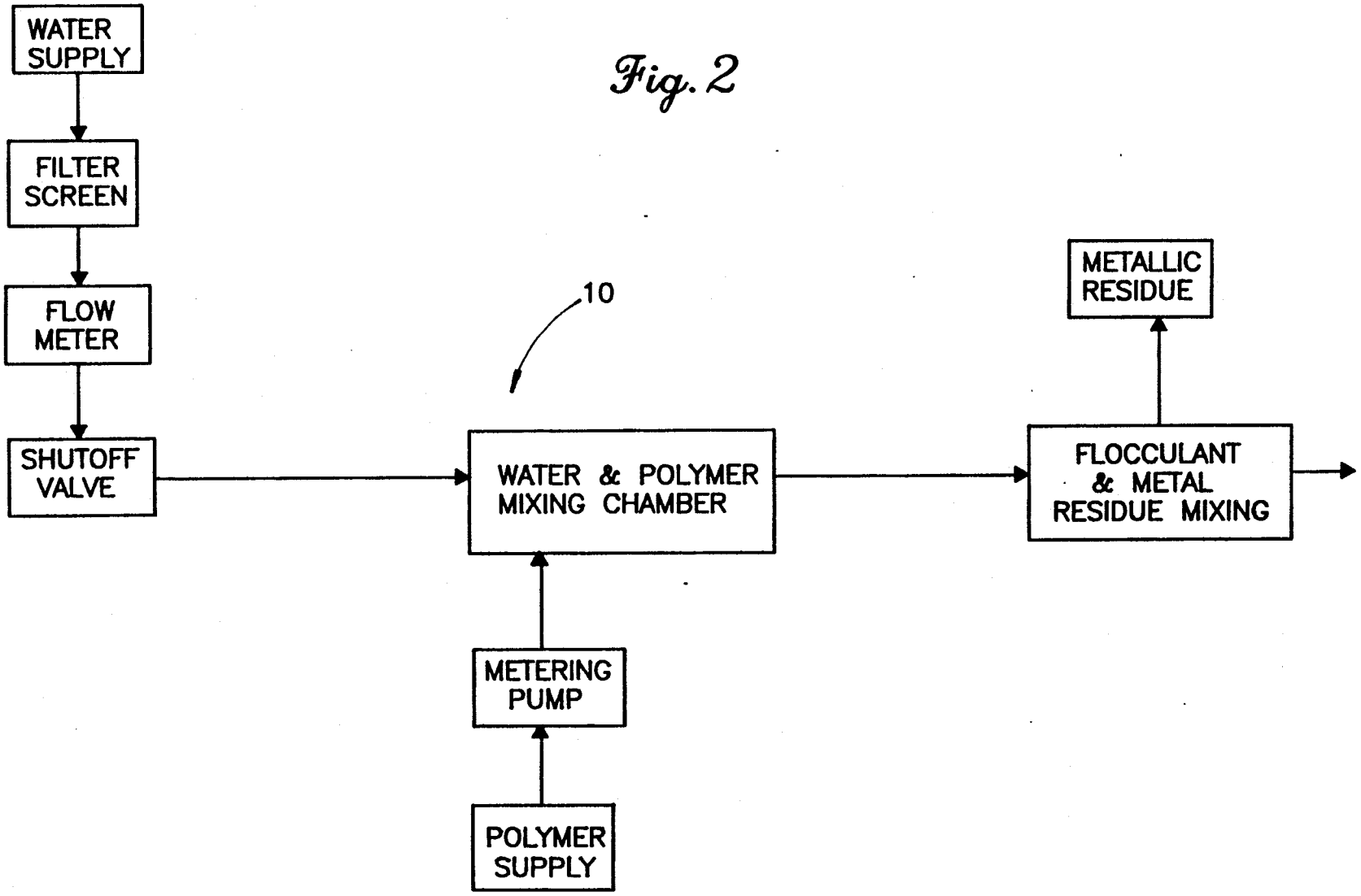
FIG. 2 is a block diagram or flow chart showing the general process in which the present invention is used.

Mixing chamber 10 may be used in the plating industry, serving as a mixing device for water and "neat" (i.e., having an electrostatic charge) long chain molecule polymer material. FIG. 2 discloses the use of such a mixing chamber 10 in such a system. Typically, metallic acid residue from plating operations is removed from solution by mixing with such a polymer, whereupon the charged metal ions are electrostatically attracted to the polymer and cling to the polymer material as it settles in a collecting reservoir. Greater efficiency may be obtained by breaking up the relatively viscous, long chain polymer molecules, e.g., by mixing the polymer with water to cause the polymer material to form a flocculent mass. Filtered water is metered, the flow controlled by a shut off valve and enters the first inner pipe or tube 14 of the mixing chamber 10 through the first inlet pipe or tube 16, as described above. The viscous polymer material is pumped into the mixing space 38 of the mixing chamber 10, whereupon it is broken up or flocculated by the water flowing through the passages 52 through 56 from the first inner pipe/tube 14 and into the mixing space 38. The water/flocculated polymer mix then flows into the second inner pipe or tube 22 by means of the passage(s) 60, and exits the chamber 10 by means of the outlet pipe or tube 25. The water/polymer mix then flows to a flocculent and metallic residue mixing tank and the metallic residue is separated out. The flocculated polymer material provides a far greater surface area due to its flocculated state than would otherwise be the case, thereby providing more efficient capture of the metallic ions in the solution.

As the above environment may contain corrosive materials, the mixing chamber 10 of the present invention is preferably formed of a non-metallic materials, such as Diastic. It has been found that standard polyvinyl chloride pipe and pipe fittings are quite suitable for the construction of the present invention for use in the environment described above. The present invention also has application to various other industries, e.g., the food industry, wherein it may be desirable to construct the device of stainless or non-corrosive steel. In other environments, other standard materials may be used, such as standard pipe and fittings of galvanized steel, cast iron, etc. as desired and as suitable for the intended use. In any case, while the mixing chamber 10 described herein may be formed generally in various ways (e.g., welding, rather than threadibly fitting the various components together), the specific construction described herein provides for the present invention to be assembled from standard, off the shelf pipe components which are readily available in a variety of material at relatively low cost, and by relatively unskilled labor. Thus, the present invention not only accomplishes the desired mixing efficiently, but also is relatively inexpensive to construct and use.

It is to be understood that the present invention is not limited to the sole embodiment described above, but encompasses any and all embodiments within the scope of the following claims.

I claim:

1. A mixing chamber providing for the mixing of two fluids, comprising:

an elongated outer housing having a first fluid inlet end and an opposite second fluid outlet end, with said outer housing including a first inner pipe and second inner pipe therewithin, with a mixing space being defined between said outer housing and said first and second inner pipes, and a second fluid inlet pipe communicating with said mixing space;

said first inner pipe having a first end and an opposite second end, with said first inner pipe's first end communicating with a first fluid inlet pipe providing for the flow of a first fluid into said mixing chamber, and said first inner pipe's second end being closed;

said second inner pipe having a first end and an opposite second end, with said second inner pipe's first end communicating with an outlet pipe providing for the flow of mixed first and second fluids from said mixing chamber, and said second inner pipe's second end being closed;

said first inner pipe's second end and said second inner pipe's second end are immediately adjacent one another, with said first inner pipe's second end and said second inner pipe's second end each having a cap sealingly secured thereto, with a sleeve being concentrically installed over each said first and second inner pipe's second end cap;

said first inner pipe including first fluid passage means therethrough, and said second inner pipe including at least one mixed fluid passage therethrough, whereby;

a first fluid flows into said first pipe by means of said inlet pipe and enters said mixing space by said first fluid passage means, a second fluid enters said mixing space by means of said second fluid inlet pipe, the first and second fluids are mixed within said mixing space, and mixed first and second fluids exit said mixing chamber by means of said at least one mixed fluid passage and then through said outlet pipe.

2. A mixing chamber providing for the mixing of two fluids, comprising:

an elongated outer housing having a first fluid inlet end and an opposite second fluid outlet end, with said outer housing including a first inner pipe and second inner pipe therewithin, with a mixing space being defined between said outer housing and said first and second inner pipes, and a second fluid inlet pipe communicating with said mixing space installed perpendicular to said outer housing and adjacent said outer housing's first end;

said first inner pipe having a first end and an opposite second end, with said first inner pipe's first end communicating with a first fluid inlet pipe providing for the flow of a first fluid into said mixing chamber, and said first inner pipe's second end being closed;

said second inner pipe having a first end and an opposite second end, with said second inner pipe's first end communicating with an outlet pipe providing for the flow of mixed first and second fluids from said mixing chamber, and said second inner pipe's second end being closed;

said first inner pipe including first fluid passage means therethrough, and said second inner pipe including at least one mixed fluid passage therethrough, whereby;

a first fluid flows into said first inner pipe by means of said inlet pipe and enters said mixing space by said first fluid passage means, a second fluid enters said mixing space by means of said second fluid inlet pipe, the first and second fluids are mixed within said mixing space, and the mixed first and second fluids exit said mixing chamber by means of said at least one mixed fluid passage and then through said outlet pipe.

3. A mixing chamber providing for the mixing of two fluids, comprising:

an elongated outer housing having a first fluid inlet end and an opposite second fluid outlet end, with said outer housing including a first inner pipe and second inner pipe therewithin, with a mixing space being defined between said outer housing and said first and second inner pipes, and a second fluid inlet pipe communicating with said mixing space;

said first inner pipe having a first end and an opposite second end, with said first inner pipe's first end communicating with a first fluid inlet pipe providing for the flow of a first fluid into said mixing chamber, and said first inner pipe's second end being closed;

said second inner pipe having a first end and an opposite second end, with said second inner pipe's first end communicating with an outlet pipe providing for the flow of mixed first and second fluids from said mixing chamber, and said second inner pipe's second end being closed; and said first inner pipe including a plurality of first fluid passage means therethrough consisting of a first, second and third group of passages, wherein said first group of passages includes at least one passage having an axis angled toward said second inlet pipe, said second group of passages includes at least one passage having an axis perpendicular to said first inner pipe, and said third group of passages includes at least one passage having an axis angled away from said inlet pipe, and said second inner pipe including at least one mixed fluid passage therethrough, whereby;

a first fluid flow into said first inner pipe by means of said inlet pipe and enters said mixing space by said first fluid passage means, a second fluid enters said mixing space by means of said second fluid inlet pipe, the first and second fluids are mixed within said mixing space, and the mixed first and second fluids exit said mixing chamber by means of said at least one mixed fluid passage and then through said outlet pipe.

* * * * *